United States Patent [19]

Lacey

[11] 4,097,932

[45] Jul. 4, 1978

[54] ATHLETIC KNEE PROTECTION DEVICE

[76] Inventor: Richard J. Lacey, 46 NE. 61st., Apt. 2B, Gladstone, Mo. 64118

[21] Appl. No.: 789,786

[22] Filed: Apr. 22, 1977

[51] Int. Cl.[2] ..... A41D 13/06

[52] U.S. Cl. ..... 2/24; 24/68 R; 128/80 C; 128/80 F

[58] Field of Search ..... 2/22, 23, 24; 128/80 C, 128/80 R, 80 F, 88, 157, 165; 24/68 R, 68 SB

[56] References Cited

U.S. PATENT DOCUMENTS

| | | | |
|---|---|---|---|
| 1,835,295 | 12/1931 | Glahe | 2/24 |
| 1,924,512 | 8/1933 | Porreca | 2/24 X |
| 2,195,024 | 3/1940 | Bullock | 2/22 X |
| 2,355,193 | 8/1944 | Walker | 2/23 X |
| 2,431,287 | 11/1947 | Washington | 2/24 X |
| 2,467,907 | 4/1949 | Peckham | 128/80 C |
| 2,532,955 | 12/1950 | Shook | 2/22 |
| 2,959,168 | 11/1960 | Shook | 128/80 F |
| 3,533,106 | 10/1970 | Kremp | 2/22 |

FOREIGN PATENT DOCUMENTS

| | | | |
|---|---|---|---|
| 453,426 | 9/1936 | United Kingdom | 2/62 |

*Primary Examiner*—Werner H. Schroeder
*Assistant Examiner*—Moshe I. Cohen
*Attorney, Agent, or Firm*—John A. Hamilton

[57] ABSTRACT

A knee protection device for use by athletes, particularly football players, consisting of a tubular boot adapted to be worn on the leg at the knee, a jointed metal reinforcing bar mounted in the boot at the inner side of the knee, a pair of straps encircling the leg and reinforcing bar respectively above and below the knee joint, and an impact-operated strap tightening device operable to tighten each of the straps whenever the knee receives a blow at its outer side.

9 Claims, 5 Drawing Figures

ATHLETIC KNEE PROTECTION DEVICE

Figure 1:
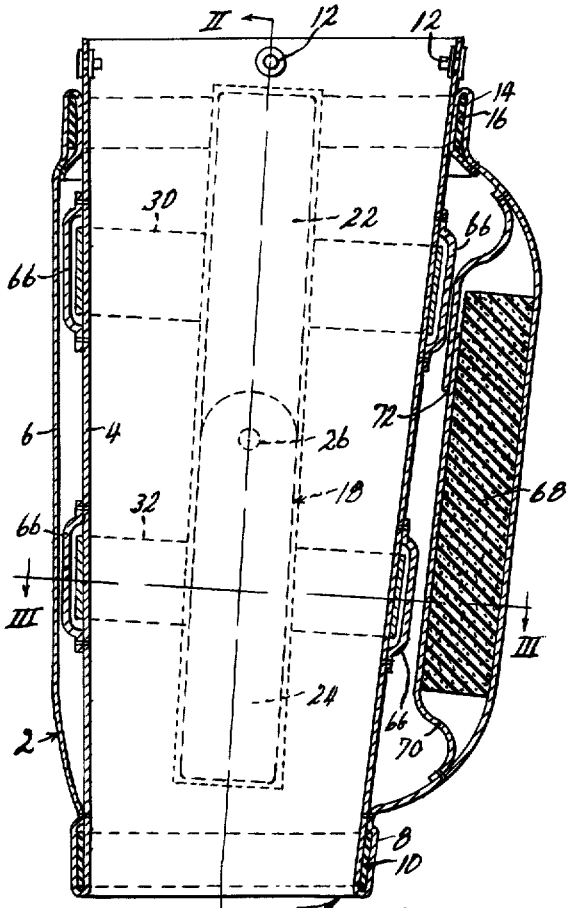

This invention relates to new and useful improvements in physical protective gear for use by athletes. It has been devised primarily for use by football players, although as will be evident it could effectively be used by almost any athlete engaged in a sport involving violent physical contact.

The high rate of incidence of knee injuries to football players, as well as other athletes, is of course well known, as is also the seriousness and long term effects of such injuries, which often end the athletic careers of the victims, and subject them to lifelong disabilities as well. The provision of a device which will reduce the rate of incidence of such injuries, and also reduce the seriousness of such injuries when they occur despite the use of the device, is the primary object of the present invention.

It has long been known that, particularly in the playing of football, the greatest proportion of serious knee injuries occur when the knee receives a heavy blow at the outer side thereof, forcing the knee joint to bend or pivot laterally, in a direction never intended by nature, and cause severe tendon, sinew and cartilage damage. Such injuries are particularly likely to occur when the foot is planted firmly on the ground, and the knee joint is fully extended to straighten the leg.

Generally, the device forming the subject matter of the present invention tends to prevent such injuries by the provision of a strong metal reinforcing bar adapted to extend along the inner side of the leg at the knee joint, said bar consisting of upper and lower sections being pivoted together coaxially with the lateral axis of the knee joint, and extending respectively above and below the joint, and a pair of straps tightly encircling both the leg and the reinforcing bar respectively above and below the joint. The bar thus strongly resists any tendency of the knee joint to buckle or pivot laterally, and absorbs much of the severe stress on the joint.

It will be apparent that the straps just referred to cannot be excessively tight at all times, since they would then be quite uncomfortable to the wearer, could interfere with blood circulation in the leg, and might interfere with the agility and freedom of movement of the wearer, since the articulation of the knee joint is rather complex and does not at all times consist of a simple pivotal motion about a single axis with which the pivotal axis of the reinforcing bar may be aligned. On the other hand, loosening the straps would reduce the protection provided by the reinforcing bar. Accordingly, another object of the invention is the provision of a device of the character described in which is included a strap tightening device operable to tighten the straps automatically in response to the delivery of a blow to the outer side of the knee. With the straps thus tightened, the device offers maximum protection, but the straps at all other times may be sufficiently loose that the device is not uncomfortable, and does not interfere with blood circulation or freedom of movement.

With the straps in their normally relatively loose condition as just described, the straps and the reinforcing bar might become disarranged relative to the leg during the violent physical motions involved in the sport, since the reinforcing bar and the strap tighteners are almost necessarily formed of metal or some other material possessing substantial weight. Disarrangement of the reinforcing bar would seriously impair freedom of movement of the knee joint, and destroy the usefulness of the bar for its intended function. Accordingly, another object of the invention is the provision of a device of the character described including means operable to support and retain said reinforcing bar, straps and strap tighteners in proper relation to the knee joint despite any looseness of said straps.

Other objects are simplicity and economy of construction, and efficiency and dependability of operation.

Figure 2:
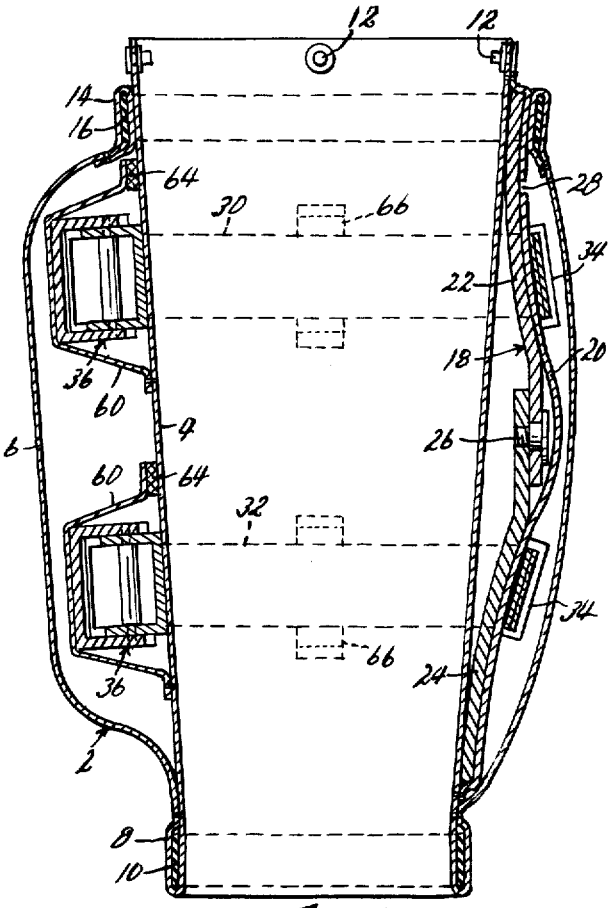
Figure 3:
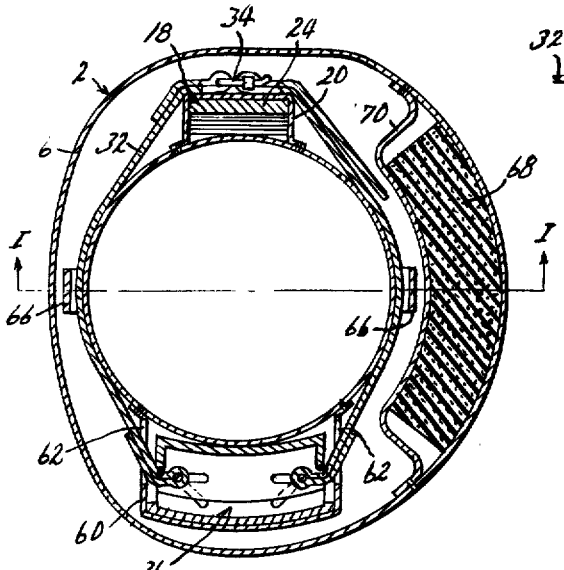
Figure 4:
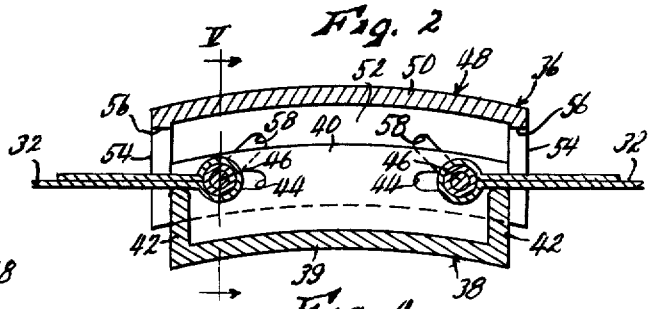
Figure 5:
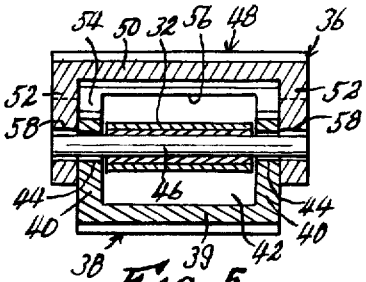

With these objects in view, as well as other objects which will appear in the course of the specification, reference will be had to the accompanying drawing, wherein:

FIG. 1 is a vertical longitudinal sectional view, taken on a front-to-rear plane, of an athletic knee protection device embodying the present invention, taken on line I—I of FIG. 3, with various layers shown somewhat separated for clarity, FIG. 2 is a sectional view taken generally on line II—II of FIG. 1, FIG. 3 is a sectional view taken generally on line III—III of FIG. 1, FIG. 4 is an enlarged, longitudinal sectional view of one of the strap tighteners, including fragmentary portions of the strap, and FIG. 5 is a sectional view taken on line V—V of FIG. 4.

Like reference numerals apply to similar parts throughout the several views. The device shown is adapted for use on the right knee. A similar device, with necessary reversals of arrangement, is used for the left knee. The device includes a tubular "boot" 2 adapted to be slipped over the leg from the foot to encompass the knee, extending both above and below the knee joint. It includes an inner sleeve 4 and an outer sleeve 6, both formed entirely of a strong but pliable cloth, said sleeves being joined together about their peripheries at their lower ends by a hemmed tube 8 including an elastic band 10 for gathering the boot snugly about the calf portion of the wearer's leg.

The upper end of inner sleeve 4 is attached to the thigh portion of the wearer's leg by any suitable means, for example by snap fastener elements 12 fixed in its upper edge for detachable engagement with mating snap fastener elements fixed in the wearer's trouser leg. Alternatively, or if the trouser leg is not of sufficient length to extend to the boot, the upper edge of sleeve 4 could be attached directly to the wearer's leg by means of adhesive tape. Outer sleeve 6 is of slightly shorter length than the inner sleeve, and is provided at its upper edge with a hemmed tube 14 in which is carried an elastic band 16 for gathering sleeve 6 snugly about sleeve 4. Boot 2 carries and supports the remaining elements of the device.

A reinforcing bar indicated generally by the numeral 18 is contained snugly in a pocket formed by a strip of cloth 20 stitched to the outer surface of inner sleeve 4 so as to extend longitudinally of the boot at the inner side of the knee. Said reinforcing bar is formed of metal, preferably aluminum for light weight, or other strong material, and consists of an upper section 22 and a lower section 24, pivotally connected together at their contiguous ends by a shouldered pivot bolt 26. The reinforcing bar is so supported by the boot that the axis of bolt 26 is coaxial with the lateral axis of the knee joint of the wearer. The portions of the reinforcing bar immediately adjacent pivot bolt 26 are offset outwardly, so as to be spaced at least slightly apart from the wearer's knee, to accommodate the "knob" of the knee, and the distal end portions of the bar lie directly against the leg, with sleeve 4 therebetween, the insulation of the cloth sleeve providing greater comfort. Also, the bar sections 22 and 24 are so bent, in the plane of the axis of bolt 26, that said axis may remain accurately coaxial with the knee axis despite the natural downward taper of the wearer's leg. For maximum comfort and efficiency, the reinforcing bar should be specially formed for each individual user. Cloth strip 20 forming the bar pocket is divided adjacent one end of the bar, as indicated at 28 in FIG. 2, to permit removal of the bar for laundering of the boot. The surface of the bar facing the leg is broad and smooth, in order that it may be pressed firmly against the leg without discomfort.

A pair of cloth straps 30 and 32 encircle inner sleeve 4 respectively above and below pivot bolt 26, so as also to pass respectively around the upper and lower sections 22 and 24 of the reinforcing bar. The straps are disposed between the inner and outer sleeves of the boot. The separable ends of each strap are releasably joined by a buckle 34 of a type which enables the strap to be drawn as tight as desired in continuously variable degrees. The buckle will secure the strap securely at the desired degree of tension, but is readily releasable when desired. Buckles of the well known sliding friction type are suitable for the purpose. Preferably, the buckles 34 are disposed generally over the reinforcing bar. Intermediate the ends of each strap connected by buckle 34, a strap tightening device indicated generally by the numeral 36 is interposed in the strap, so as to be disposed at the outer side of the leg.

Although the strap tightener 36 may be of different types, it will be seen that, as detailed in FIGS. 4 and 5, it includes a base member 38 formed of metal, preferably aluminum for light weight, or other strong material such as impact-resistant plastic, and having the form of a shallow rectangular cup the floor 39 of which rests against the wearer's leg, with sleeve 4 therebetween and which is curved generally to conform to the contour of the leg, a pair of parallel side walls 40 disposed generally parallel to the plane of the strap loop, and a pair of parallel end walls 42 disposed generally at right angles to the plane of the strap loop. Each of side walls 40 has a pair of slots 44 formed therethrough, said slots being generally parallel to floor 39 and being disposed respectively adjacent opposite end walls 42. A pair of pins 46 extend transversely between side walls 40, and have reduced end portions, said reduced end portions of each pin being engaged in one corresponding pair of slots 44 for transverse sliding movement therein. The strap 30 or 32 is divided at the tightener and the resulting strap ends are affixed respectively around the two pins 46, as shown, and extend outwardly from the base over the rounded free outer edges of end walls 42. The tension of the strap normally positions pins 46 in the distal ends of slots 44.

Strap tightener 36 also includes a cap member 48 formed of the same material as base 38 and likewise of rectangular cup form, although inverted with respect to said base. It has a broad smooth outer wall 50 generally parallel to base floor 39, side walls 52 and end walls 54, said side and end walls being telescoped slidably over the corresponding side and end walls of the base. End walls 54 are windowed as at 56 to accomodate the strap ends extending from pins 46. Side walls 52 each have a pair of slots 58 formed therethrough, respectively adjacent end walls 54, and inclined so as to converge in a direction away from floor 39 of base 38. The reduced ends of each pin 46 also extend into the corresponding slots 58 for transverse sliding movement therein. When pins 46 are engaged in the distal ends of slots 44 by strap tension, they are engaged also in the ends of slots 58 closest to base floor 39, so that cap 48 is also maintained in an outward position relative to base 38 by the strap tension. However, if a blow is delivered to outer wall 50 of cap 48, as when a ball carrier is hit at the knees by a tackler in a football game, the cap is forcibly telescoped inwardly over base 38, and the slots 44 and 58 cooperate to force pins 46 closer together thereby tightening the belt around the wearer's leg and reinforcing bar 18.

Each belt tightener 36 is carried in a cloth pocket 60 sewed to the outer surface of inner boot sleeve 4. Said pocket is apertured at its sides, as indicated at 62 in FIG. 3, to accomodate the strap connections to the tightener, and is releasably closed at its top edge by any suitable fastener 64, such as the commonly known "VELCRO" fastening, securing said top edge to sleeve 4. By releasing fasteners 64, and disengaging buckles 34, the strap tighteners, together with the straps and buckles, may be removed from the boot for easy laundering of the latter. The straps may also be supported at any desired number of points along their lengths by cloth keepers 66 stitched to the outer surface of boot sleeve 4. A knee pad 68, consisting of a thick slab of foam rubber or the like, is carried in a cloth pocket 70 stitched to the inner surface of outer boot sleeve 6, so as to overlie the front of the wearer's knee. Pocket 70 is also divided, as indicated at 72 in FIG. 1, to permit removal of the pad when laundering the boot.

To apply the device, outer boot sleeve 6 is first everted downwardly from inner sleeve 4 to expose the outer surface of the latter, and the boot is then slipped over the leg from the foot and pulled up till the inner sleeve encompasses the knee, and the upper edge of said inner sleeve is attached to the trouser leg by snap fasteners 12, or by taping it directly to the wearer's leg, or by other suitable means. At this time, the axis of pivot bolt 26 must be accurately coaxial with the lateral axis of the knee joint. If snap fasteners 12 or other fasteners of comparable type are used, the mating fastener elements of the wearer's trouser leg will have been preset to the proper positions, according to the individual requirements of each wearer. If adhesive tape is used, straps 30 and 32 should first be pulled reasonably snug but not tight, and sleeve 4 then manually adjusted on the leg, while flexing the knee repeatedly, until the position of bolt 26 is such that the knee may be flexed freely, before applying the adhesive tape.

Straps 30 and 32 are then pulled up as tightly as may be comfortably endured for extended periods of time, but not excessively tightly. If excessively tight they would, in extended periods of wear, be quite uncomfortable and interfere with blood circulation in the leg, and in fact would somewhat inhibit free movement of the knee joint, since knee flexure is a somewhat complex movement and not always precisely on a single axis. Thus at least some yieldability in the position of reinforcing bar 18 relative to the leg is normally required. Experience is the best teacher in learning how tight to draw the straps when applying the device. The strap tension at this time is more than ample to draw pins 46 of strap tighteners 48 to the distal ends of slots 44 of the tightener bases 38, and hence to telescope tightener caps 48 outwardly relative to said bases, to the positions shown in FIG. 4. The outer sleeve 6 is then everted upwardly over the exterior surface of the inner sleeve, to the position shown in FIGS. 1 - 3, in which position it conceals the straps, strap tighteners, etc., positions knee pad 68 properly, and is secured by elastic band 16.

In operation, it will be seen that whenever the wearer receives a heavy blow at the outer side of the knee, as in some football tackles, the blow will be received on the outer walls 50 of caps 48 of the strap tighteners, and will drive said caps telescopingly inwardly over base portions 38 of the tighteners, which are based substantially directly on the wearer's leg. This relative movement of the tightener caps and bases causes slots 44 and 58 thereof to cooperate to force pins 46 of each tightener closer together, thereby tightening the straps around the leg and around the reinforcing bar, as previously described. If the straps were already as tight as comfortably possible, the action of the tighteners can draw them extremely tight indeed. This tightening of the straps draws reinforcing bar 18 into very firm and tight relationship to the wearer's leg, whereby it offers, by its rigidity against lateral flexure, still better support to the leg to prevent injurious transverse flexure of the knee joint, that is, better support than would be provided in the absence of the tighteners. The straps actually could be manually tightened to the same degree as provided by the tighteners, but as previously discussed, this would be quite uncomfortable, could interfere with blood circulation, and inhibit free and full flexure of the knee. The tighteners supply the extreme strap tension only at the moments it is needed, and thereafter immediately relax the tension.

Boot 2 should not be regarded simply as a means for carrying and concealing the primary elements of the device, which are the reinforcing bar, the straps, and the strap tighteners. Actually, it has an important operational function. The reinforcing bar and tighteners have a substantial weight, and since the straps are drawn to full tightness only occasionally, when said full tightness is required, the bar and tighteners would tend to move relative to the leg and become disarranged during the strenuous physical activity in which the wearer is engaged, if some means were not provided to prevent it. As a matter of fact, said disarrangement could occur even if the straps were drawn to full tightness, most notably by working or sliding downwardly on the leg, due to the general downward taper of the leg. Such disarrangement of course cannot be permitted, and boot 2 provides the means for preventing it. Inner sleeve 4 of the boot carries virtually all of the primary operating elements, so that the attachment of the upper edge of said sleeve to the wearer's leg or trousers supports these elements and prevents them from moving down the leg. Only knee pad 68 is carried by the outer sleeve 6, and its weight is negligible. Pockets 20 and 60 of the inner sleeve maintain the reinforcing bar and strap tighteners in proper position relative to said sleeve, and keepers 66 maintain the straps in proper alignment. Thus the boot provides means for maintaining the reinforcing bar, straps and strap tighteners in proper positional relation to the wearer's knee joint at all times, in spite of the fact that the straps are not normally, for the reasons previously discussed, drawn to full tightness.

While I have shown and described a specific embodiment of my invention, it will be readily apparent that many minor changes of structure and operation could be made without departing from the spirit of the invention.

What I claim as new and desire to protect by Letters Patent is:

1. An athletic knee protection device comprising:

a. an elongated reinforcing bar consisting of two rigid sections pivotally joined at their contiguous ends, b. supporting means operable to support said reinforcing bar to extend along a wearer's leg at the inner side thereof, extending both above and below the knee joint, with the axis of the pivotal connection of said bar sections substantially coaxial with the lateral axis of said knee joint, c. a pair of straps adapted to encircle tightly the leg of the wearer, and said reinforcing bar, respectively above and below the knee joint and the pivotal connection of said reinforcing bar sections, whereby said reinforcing bar sections are secured firmly relative to the wearer's leg, and d. a strap tightener interposed in each of said straps whereby to be disposed at the outer side of the wearer's leg, and each being operable by the impact of a blow thereagainst to draw the associated strap still more tightly about the wearer's leg and about said reinforcing bar.

2. A device as recited in claim 1 wherein each of said strap tighteners comprises:

a. a base portion effectively seated against the wearer's leg, b. a cap portion movable on said base portion in a direction generally radial to the loop of the strap, and c. a pair of strap mounting members carried by said base and cap portions and operable to be moved closer together, circumferentially of the loop of said strap, responsively to radially inward movement of said cap portion relative to said base portion, ends of said strap being attached to said strap mounting members.

3. A device as recited in claim 2 wherein said tightener base and cap portions each comprise a cup shaped member, the base cup being effectively based on the wearer's leg and opening outwardly, and the cap cup being telescopingly engaged over said base cup and opening inwardly, and wherein said strap mounting members comprise a pair of pins extending transversely of the strap loop within the cups of the tightener and spaced apart circumferentially of the strap, the strap being divided within the tightener cups and the resulting strap ends affixed respectively to said pins, the ends of each of said pins extending for transverse sliding movement into slots formed in side walls of said tightener cups which are generally parallel to the plane of the strap loop, said slots of the two cups being so relatively angled, in a plane transverse to the pins, as to force said pins relatively closer together to tighten said strap whenever said cap cup is forced inwardly relative to said base cup by a blow against the former.

4. A device as recited in claim 3 wherein the pin slots in the side walls of said base cup extend in a direction generally circumferential to the strap loop, and wherein the pin slots in the side walls of said cap cup are angularly convergent in a direction radially outward from the strap loop.

5. A device as recited in claim 1 wherein said supporting means comprises a tubular boot including a tubular inner sleeve of pliable material adapted to be worn about the leg in direct contact with the leg, said sleeve having a pocket formed therein adapted to contain said reinforcing bar snugly therein, the upper end of said sleeve being firmly attachable to the leg of the wearer, whereby to support said reinforcing bar against downward movement on the wearer's leg.

6. A device as recited in claim 1 wherein said supporting means comprises a tubular boot including a tubular inner sleeve of pliable material adapted to be worn about the leg in direct contact therewith, said sleeve having pockets formed therein adapted to receive said reinforcing bar and each of said strap tighteners snugly therein, the upper end of said sleeve being firmly attachable to the leg of the wearer, whereby to support said reinforcing bar and strap tighteners against downward movement on the wearer's leg.

7. A device as recited in claim 6 wherein said sleeve is provided at its upper end with means for attaching it firmly but detachably to a trouser leg of the wearer.

8. A device as recited in claim 6 wherein said boot additionally includes:

a. an outer sleeve of pliable material secured at its lower end to the lower end of said inner sleeve and being evertable to selectively conceal or disclose the elements carried by said inner sleeve, and b. elastic means operable to secure the upper end of said outer sleeve snugly about said inner sleeve.

9. A device as recited in claim 8 wherein said outer sleeve has a pocket formed therein so as to be disposed forwardly of the wearer's knee, and with the addition of a knee pad of cushioning material disposed in said pocket.

* * * * *